US011376865B2

(12) United States Patent
Kato

(10) Patent No.: US 11,376,865 B2
(45) Date of Patent: Jul. 5, 2022

(54) PRINTER

(71) Applicants: CITIZEN WATCH CO., LTD., Tokyo (JP); CITIZEN SYSTEMS JAPAN CO., LTD., Tokyo (JP)

(72) Inventor: Yukihisa Kato, Tokyo (JP)

(73) Assignees: CITIZEN WATCH CO., LTD., Tokyo (JP); CITIZEN SYSTEMS JAPAN CO., Tokyo (JP)

( * ) Notice: Subject to any disclaimer, the term of this patent is extended or adjusted under 35 U.S.C. 154(b) by 149 days.

(21) Appl. No.: 17/082,461

(22) Filed: Oct. 28, 2020

(65) Prior Publication Data

US 2021/0129554 A1 May 6, 2021

(30) Foreign Application Priority Data

Nov. 1, 2019 (JP) ..... JP2019-200077

(51) Int. Cl.
*B41J 3/407* (2006.01)
*B41J 11/70* (2006.01)

(52) U.S. Cl.
CPC ..... *B41J 3/4075* (2013.01); *B41J 11/70* (2013.01)

(58) Field of Classification Search
CPC ..... B41J 3/4075; B41J 11/70; B41J 11/703; B41J 11/42; B41J 2/315; B41J 2/325; B41J 2/32; B41F 16/00; B41F 16/0006; B41F 16/0026; B41F 16/0033
See application file for complete search history.

(56) References Cited

U.S. PATENT DOCUMENTS 8,979,236 B1 * 3/2015 Idehara ..... B41J 3/4075 347/104
2014/0253623 A1 * 9/2014 Nakano ..... B41J 11/0045 347/16
2018/0282103 A1 * 10/2018 Sato ..... B65H 35/0093

FOREIGN PATENT DOCUMENTS

JP H04130862 U 12/1992
JP H08208110 A 8/1996
JP 2002103709 A 4/2002
JP 2018167473 A 11/2018

* cited by examiner

*Primary Examiner* — Kristal Feggins
(74) *Attorney, Agent, or Firm* — Tucker Ellis LLP

(57) ABSTRACT

A printer includes a print head portion for printing on a label paper, a feeding portion for feeding the label paper, a cutter portion for cutting the label paper, and a controller for controlling operations of the print head portion, the feeding portion, and the cutter portion. The label paper includes a bent portion that is generated in a portion right after unrolled from a label roll and changes in accordance with a label roll diameter. The controller is configured to control the feeding portion to feed the label paper by a constant length set in advance with respect to a predetermined label roll diameter so that a cutting operation by the cutter portion is performed at a position past a bent portion generated when the label roll diameter is larger than the predetermined diameter if the feeding operation for the label paper meets a predetermined condition set in advance.

5 Claims, 4 Drawing Sheets

PRINTER

CROSS-REFERENCE TO RELATED APPLICATION

This application is based upon and claims the benefit of priority from Japanese Patent Application No. 2019-200077 filed to Japan Patent Office on Nov. 1, 2019, the entire disclosure of which is incorporated herein by reference.

TECHNICAL FIELD

A present disclosure relates to a printer.

BACKGROUND ART

A printer that prints on paper wound in a roll is known in the art. The printer unwinds or unrolls the paper from the roll paper and the unrolled paper is fed to a printer head and the like by rollers.

In the case that the waiting time after printing becomes relatively long, the roller causes a portion of the paper that contacts the roller to keep curling, resulting in the generation of a curled portion in the paper that corresponds to an arc on the outer circumferential surface of the roll. If the paper is cut off before the curled portion (forward of ejection port in feeding direction), the curled portion is left at the leading end of the following paper. As a result, a paper jam that the curled portion is stuck in the feed path may easily occur.

To solve the above issue, it has been proposed to prevent the curled portion to be left at the leading end of the following paper by cutting the paper at a position where the curled portion has passed (see JP2018-167473A, for example).

An example of the roll paper is a label roll. The label roll includes one or more labels and a long strip liner or release paper. The label includes an adhesive on the backside thereof and attached to the liner. The label roll is formed by winding or rolling the label attached to the liner in a roll such that the printing side (i.e., front side) of the label becomes the outer circumference side of the label roll.

There is a label roll without a liner (i.e., linerless label roll). The linerless label roll can be formed only with the label to be printed and accordingly the label can be formed longer. Further, in the linerless label roll, a useless liner is not left after printing, and accordingly, waste is not produced. Accordingly, the linerless label roll is attracting attention in terms of environmental protection.

In the label roll having the liner, the roll paper is unrolled tangentially to the outer circumferential surface of the roll when unrolled from the roll. On the other hand, in the linerless label roll, the adhesive surface of the label adheres to the front surface of the label wound into the roll. Accordingly, when the label paper is unrolled from the roll, an unrolled portion of the paper keeps adhering until a position beyond the tangential position of the outer circumferential surface of the roll so as to be bent and unrolled in a direction close to the normal direction with respect to the outer circumferential surface of the roll.

Accordingly, the portion right after being unrolled from the roll is strongly bent or curved with respect to the outer circumferential surface of the roll. If this state continues for an extended period of time, for example, when the printing is paused, the strongly bent portion is kept being bent or curved opposite to the direction of the curled portion (curl) generated when the paper was wound in the roll. As a result, such a bent portion (hereinafter, referred to as bent portion or reverse curled portion) is left or sustained in the paper.

Accordingly, if the paper is cut off before the bent portion (i.e. forward of bent portion in feeding direction to ejection port), the bent portion is stuck in the feed path to generate the paper jam.

To overcome the above issue, it is conceivable to apply the prior art disclosed in JP2018-167473A. However, this prior art addresses the curled portion generated by contacting the roller on the feed path. Accordingly, the paper bends or curves regardless of the size of the roll diameter.

In the linerless label roll, the bent portion or reverse curled portion to be generated has the characteristic whose shape and position change depending on the size of the roll diameter. This is caused by the change in the size of the curled portion of the roll depending on the roll diameter and change in the distance from the inlet of the feed path to a portion where the label paper is unrolled from the roll.

Accordingly, an object of the present disclosure is to provide a printer that appropriately prevents the paper jam due to the bent portion of the label paper.

SUMMARY

The present disclosure relates to a printer for printing on a label paper unrolled from a linerless label roll. The printer includes a print head portion that is configured to print on the label paper, a feeding portion that is configured to feed the label paper, a cutter portion that is configured to cut the label paper, and a controller that is configured to control operations of the print head portion, the feeding portion, and the cutter portion. The label paper includes a bent portion generated in a portion right after unrolled from the label roll, the bent portion changing in accordance with a diameter of the label roll. The controller is configured to control the feeding portion to feed the label paper by a constant length that is set in advance with respect to a predetermined diameter of the label roll so that a cutting operation by the cutter portion is performed at a position past a bent portion that is generated when the diameter of the label roll is larger than the predetermined diameter if the feeding operation for the label paper meets a predetermined condition set in advance.

DETAILED DESCRIPTION

With respect to the use of plural and/or singular terms herein, those having skill in the art can translate from the plural to the singular and/or from the singular to the plural as is appropriate to the context and/or application. The various singular/plural permutations may be expressly set forth herein for the sake of clarity.

Hereinafter, an embodiment of a printer of the present disclosure will be disclosed with reference to the drawings.

Figure 1:
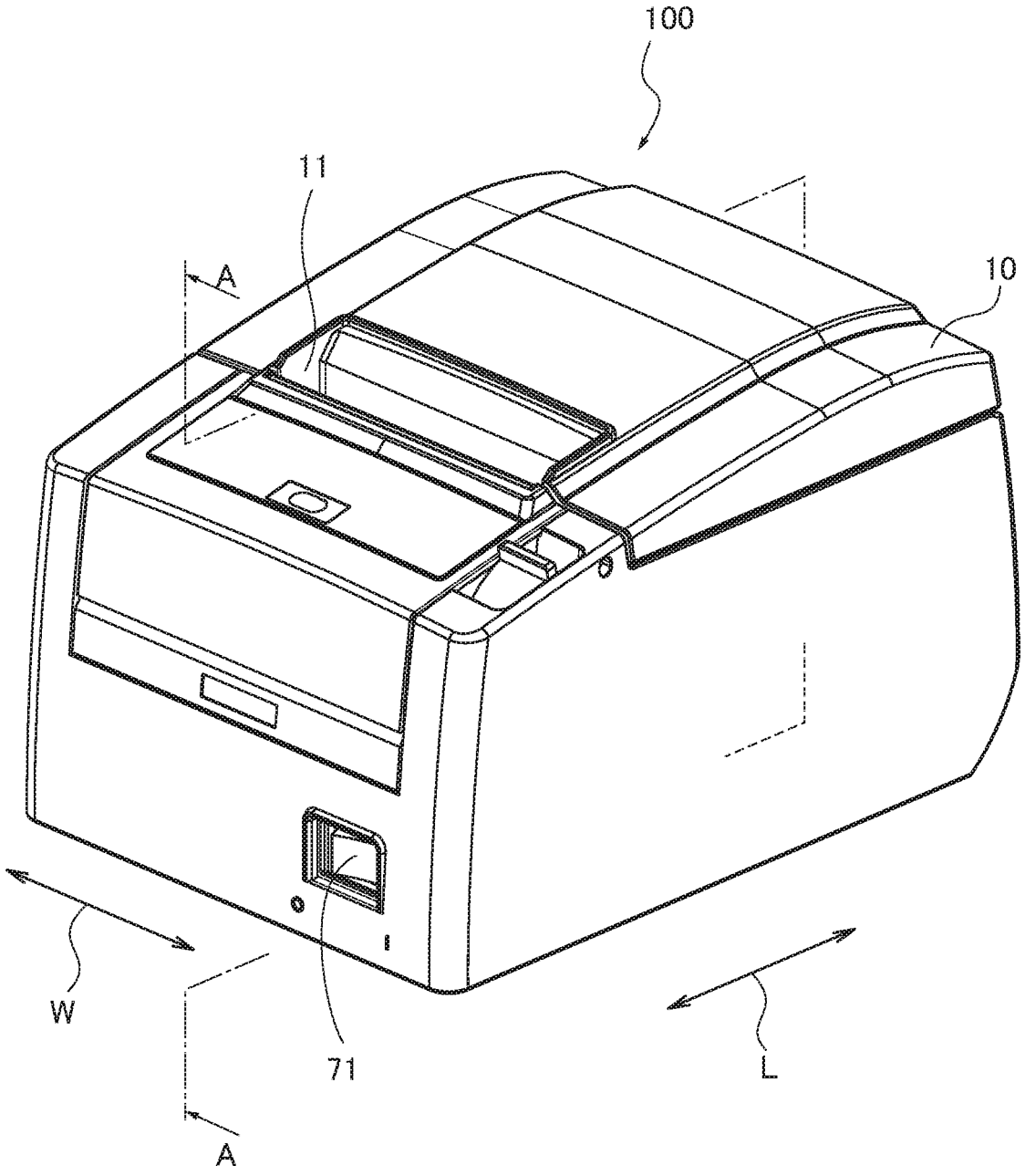
FIG. 1 is a perspective view illustrating a thermal transfer printer according to an embodiment of a printer in the present disclosure.
Figure 2:
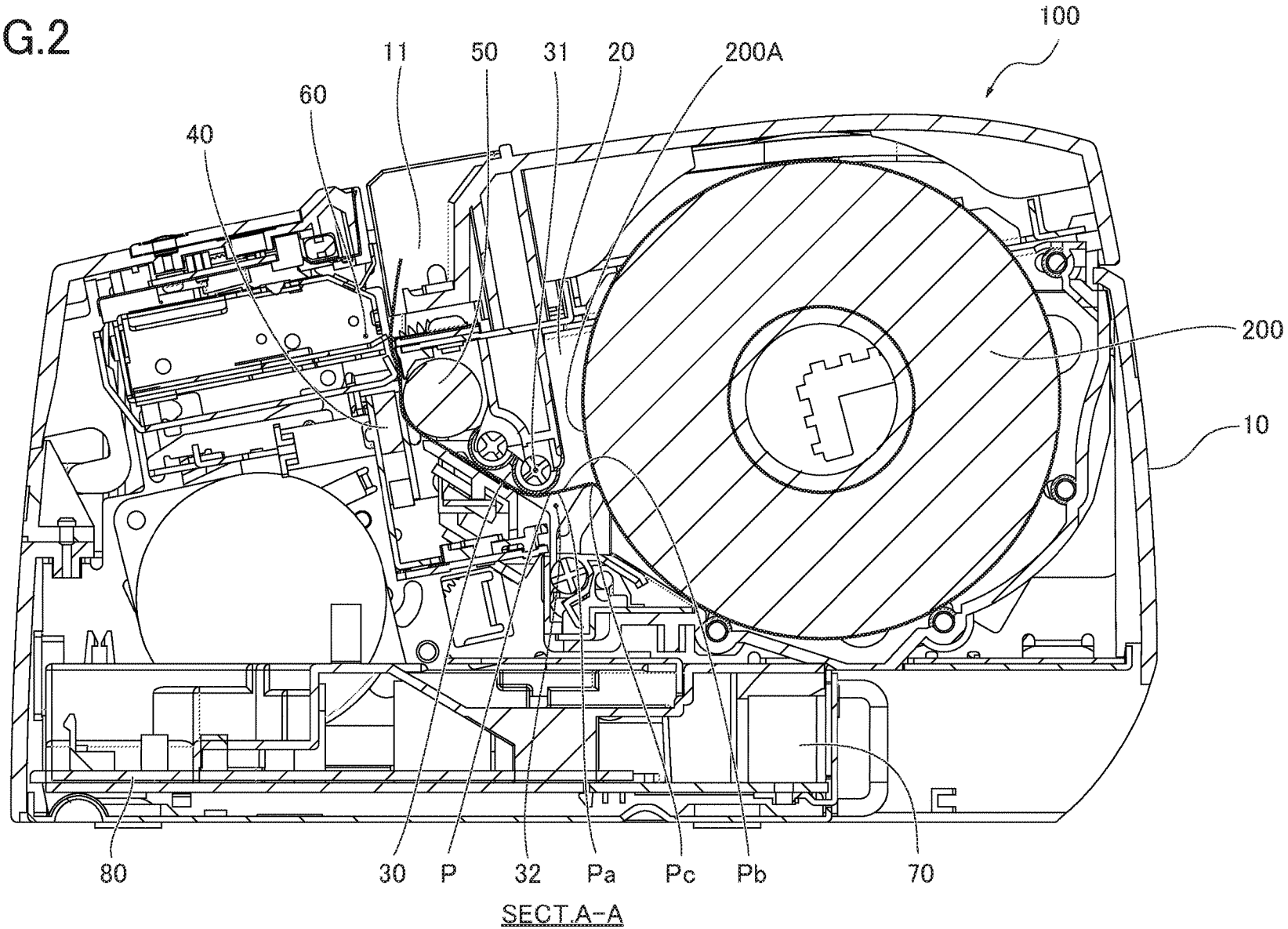
FIG. 2 is a cross-sectional view illustrating the printer that is cut along a line A-A shown in FIG. 1 in a vertical plane including a longitudinal direction L, the printer including a label roll having a larger diameter.
Figure 3:
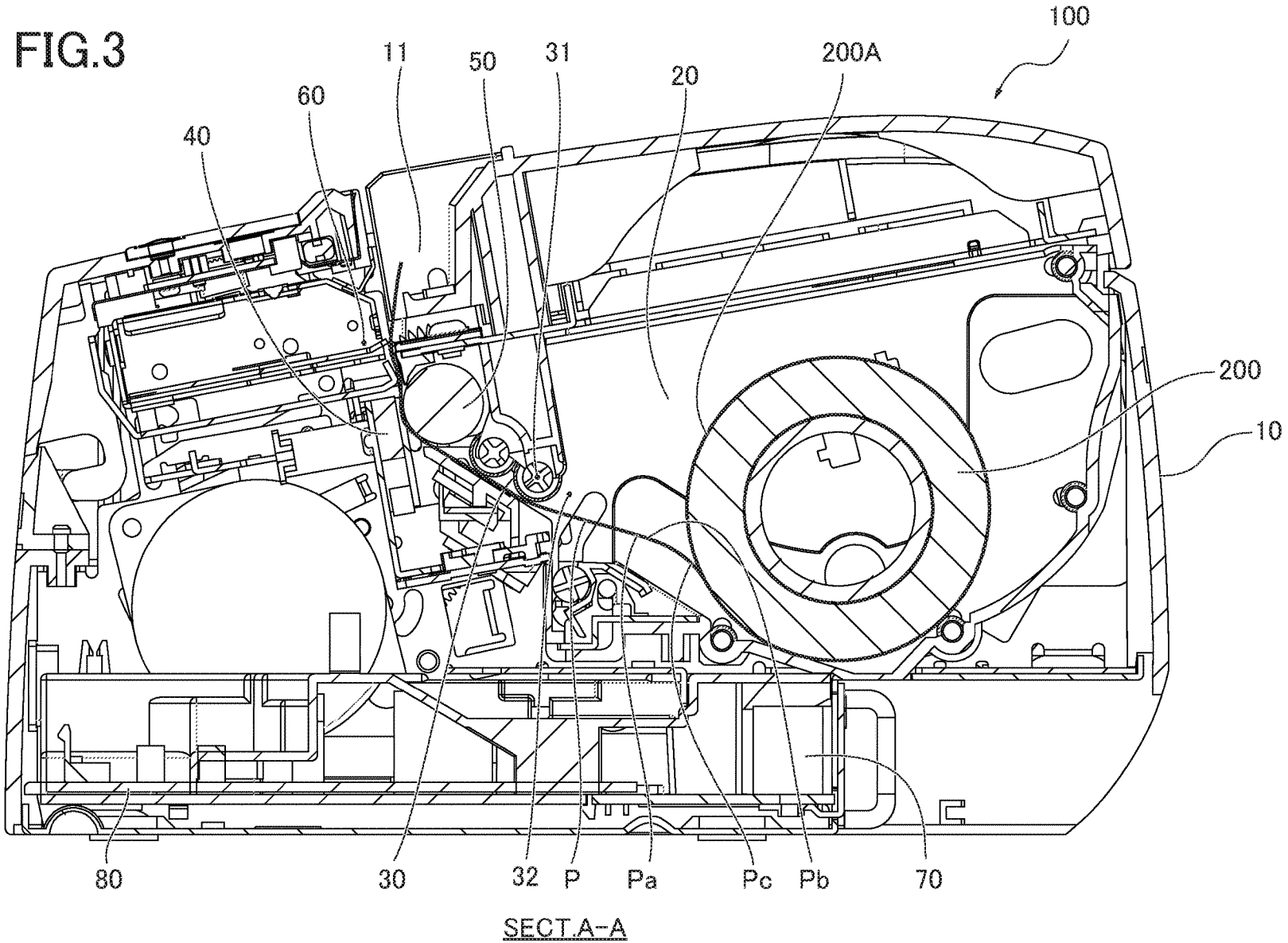
FIG. 3 is a cross-sectional view illustrating the printer that is cut along the line A-A shown in FIG. 1 in the vertical plane including the longitudinal direction L, the printer including the label roll having a smaller diameter.

FIG. 1 is a perspective view illustrating a thermal transfer printer 100 according to an embodiment of a printer of the present disclosure. In FIG. 1, a reference sign "L" denotes a longitudinal direction of the printer 100 and a reference sign "W" denotes a width direction thereof. FIGS. 2 and 3 are cross-sectional views illustrating the printer that is cut along the line A-A shown in FIG. 1 in the vertical plane including the longitudinal direction L. FIG. 2 illustrates a label roll 200 having a larger diameter while FIG. 3 illustrates the label roll 200 having a smaller diameter.

As shown in FIG. 2, the printer 100 shown in FIG. 1 includes an outer casing 10, a paper storage portion 20, a transport or feed path 30, a thermal head portion 40, a platen roller 50, a cutter portion 60, a power supply 70, and a controller 80, which are housed in the outer casing 10.

The outer casing 10 includes an ejection port 11 for ejecting printed label paper P. Also, the outer casing 10 includes a button or switch 71 on the front side thereof (see FIG. 1). The switch 71 is configured to turn on or off the power supply 70.

As shown in FIG. 2, the paper storage portion 20 stores a linerless label roll 200. The linerless label roll 200 is formed by rolling or winding the long strip label paper P having no release paper in a roll.

The label paper P is thermal paper that is printed by heat from the thermal head portion 40. The label paper P includes a front surface Pa and a back surface Pb. The front surface Pa is a side to be printed and faces an outer circumferential surface 200A side of the label roll 200. The back surface Pb is provided with an adhesive and faces the inner circumferential surface side of the label roll 200. The label paper P is rolled in a clockwise direction in the cross-section shown in FIG. 2.

The feed path 30 is a passage for the label paper P through which the unrolled label paper P from the outer circumferential surface 200A side of the label roll 200 is fed from the paper storage portion 20 to the ejection port 11. The feed path 30 is partitioned by surrounding partitioning members.

The platen roller 50 is disposed to contact the back surface Pb of the label paper P in the feed path 30. The platen roller 50 rotates in the clockwise direction in FIG. 2 to feed the label paper P to the ejection port 11. For example, a stepping motor rotates the platen roller 50.

The thermal head portion 40 is disposed opposite to the platen roller 50 with the feed path 30 therebetween. In other words, the thermal head portion 40 is disposed in the front surface Pa side of the label paper P in the feed path 30 to sandwich the label paper P with the platen roller 50.

The thermal head portion 40 includes heating elements linearly arranged in the width direction W (i.e. depth direction in FIG. 2). The thermal head portion 40 is configured to perform printing on the front surface Pa by generating heat for each of the heating elements according to the content to be printed while the label paper P is fed by the rotation of the platen roller 50.

The cutter portion 60 is disposed in the feed path 30 closer to the ejection port 11 than the thermal head portion 40 and the platen roller 50. In other words, the cutter portion 60 is disposed downstream of the thermal head portion 40 and the platen roller 50. The cutter portion 60 includes a fixed blade and a movable blade. The fixed blade is disposed with respect to the back surface Pb of the label paper P. The movable blade is disposed with respect to the front surface Pa.

The movable blade is movable toward the fixed blade. The label paper P is cut by being sheared between the movable blade and the fixed blade. A piece of the paper cut from the label paper P is held out of the ejection port 11.

The power supply 70 transforms the power from an external commercial power source and supplies it to the controller 80. The power is supplied from the power supply 70 to the controller 80 when the switch 71 for the power supply 70 is turned on. The power from the power supply 70 to the controller 80 is cut off when the switch 71 is turned off.

The controller 80 is configured to control an operation for generating heat of the heating elements of the thermal head portion 40 with the power from the power supply 70, an operation for driving a stepping motor to rotate the platen roller 50, and an operation for moving the movable blade of the cutter portion.

The controller 80 is also configured to control the feed length (or transport length) of the label paper P by the platen roller 50 such that the cutter portion 60 cuts the label paper P at a position rearward or downstream of the printed portion of the label paper P in the feeding direction. The printing operation is performed on this printed portion by the thermal head portion 40 and the platen roller 50.

The controller 80 controls the feed length of the label paper P by the platen roller 50 such that the cutter portion 60 usually cuts a portion right after the printed portion of the label paper P. Thereby, no useless margin is left on the label paper P. The control of the feed length of the label paper P that corresponds to the print length is referred to as normal feed control herein.

Specifically, a last or rearmost part of the printed portion when the printing is completed is located at a position opposite to the thermal head portion 40 on the feed path 30. In the normal feed control, the label paper P is fed by the length from the thermal head portion 40 to the cut position of the cutter portion 60 along the feed path 30 such that the rearmost printed part passes the cut position of the cutter portion 60 on the feed path 30 and the label paper is cut at the margin right after the rearmost printed part.

Accordingly, in the normal feed control, the label paper P is fed by the total length of the feed length associated with the printing and the length fed to the cutter portion after the printing.

In addition to the normal feed control described above, the controller 80 for the printer 100 of the present embodiment also controls the feeding operation of the platen roller 50 to feed the paper P at least by the predetermined constant length to the cut position. Specifically, when the elapsed time from the last feeding operation exceeds a preset time (e.g. four hours) and a first printing operation after the preset time has elapsed is performed, the controller 80 controls the feeding operation of the platen roller 50 to feed the paper P at least by the predetermined constant length to the cut position even if the length of the printed portion is relatively short as long as the print length does not exceed a bent portion or reverse curled portion Pc, which is described below. As described above, the control to feed by the fixed constant length regardless of the print length is referred to as constant length feed control herein.

Note that the condition that the elapsed time from the last feeding operation exceeds the preset time (e.g., four hours) is one of the predetermined conditions to determine performing the constant length feed control.

The predetermined constant length is a constant length to a position rearward or upstream in the feed direction of a strongly bent portion Pc (hereinafter referred to as bent portion or reverse curled portion Pc). The bent portion Pc is generated in a portion of the label paper P right after unrolled from the label roll 200 when the label roll 200 has the larger diameter shown in FIG. 2. The bent portion or reverse curled portion of the paper P herein means that a portion of the paper P that bends or curls in the opposite direction to the radially inwardly curled portion that is generated when being wound in the roll.

The bent portion Pc is generated when the portion right after unrolled from the label roll 200 is radially outwardly bent with a very small bending radius R with respect to the label roll 200 and kept being bent for more than a predetermined amount of time. Also, the bent portion Pc is the portion that is not back to the original gentle curl state (i.e., radially inwardly curl state generated when being wound into the label roll).

The constant length feed control to feed the paper by the predetermined length is performed only at a first feeding operation after the elapsed time from the last feeding operation exceeds a preset time (e.g., four hours) so that the label paper P is cut from the label roll at the position past the bent portion Pc. This prevents the bent portion Pc from being left at the leading (forward or downstream in the feed direction) end of the label paper P that has not been cut from the label roll 200.

In other words, in the constant length feed control, the paper is not fed so that the rearmost printed portion passes the cut position of the cutter portion 60 on the feed path 30 and the paper is not cut at the margin right after the rearmost printed portion. Actually, in the constant length feed control, the label paper P is fed by the length so that the bent portion Pc passes the cut position.

Accordingly, in the constant length feed control, the label paper P is fed by the predetermined length until the bent portion Pc passes the cut position along the feed path 30 even if the feed length by the printing is relatively short.

As a result, the bent portion Pc is cut off after the printing so as to prevent the label paper P from being stuck in the feed path 30 at the next feeding, which would occur in the case that the bent portion Pc is left at the leading end of the label paper P in the feed direction.

The constant length of the label paper P fed by the constant length feed control is a length from the cut position to the position past the bent portion Pc along the feed path 30 plus the variation due to the type of the label roll 200 and the environment in which the printer is used when the label roll 200 has the relatively large diameter (initial state at the beginning of use, for example).

The label paper P wound around the label roll 200 is attached or stuck to the outer circumferential surface 200A of the label roll 200 by the adhesive provided on the back surface Pb. Therefore, when the label paper P is pulled to be unrolled or unwound from the label roll 200, the label paper P is unrolled at the position along the outer circumferential surface 200A that advances clockwise from a position in the tangential direction of the outer circumferential surface 200A where it is unrolled when there is no adhesive strength. As a result, the label paper P is unrolled at the position where the distance from a roller 31 located at the end of the feed path 30 to the label roll 200 becomes approximately the shortest or at a position close to the above position depending on the adhesive force or the like.

The label roll 200 is externally constrained by the paper storage portion 20 when the diameter of the label roll 200 is relatively large (see FIG. 2). Accordingly, the label roll 200 is not significantly displaced within the paper storage portion 20. Thereby, the bent portion Pc is generated at a position of the shortest length from the roller 31 toward the label roll 200 on the feed path 30 or a position close to the above position.

On the other hand, as shown in FIG. 3, when the diameter of the label roll 200 is relatively small since the label paper P is used, the label roll 200 is not easily externally constrained by the paper storage portion 20. Accordingly, the label roll 200 is not held at the position of the shortest length from the roller 31 on the feed path 30 and is positioned at the bottom of the paper storage portion 20 by its own weight.

As a result, the distance between the portion (bent portion Pc) right after unrolled from the label roll 200 and the roller 31 on the feed path 30 is farther than that of the label roll 200 having a relatively large diameter (see FIG. 2).

When the label paper P is unrolled from the label roll 200 by being pulled (fed), the label roll 200 is pulled toward the roller 31 on the feed path 30 so that the outer circumferential surface 200A of the label roll 200 is moved to the shortest position from the roller 31, which is the same as the case that the label roll 200 has the relatively large diameter shown in FIG. 2.

However, when the pulling of the label paper P is stopped, the label roll 200 is not held at the position of the shortest length from the roller 31 on the feed path 30 but moves back to the bottom of the paper storage portion 20 by its own weight. At this time, the label paper P is further unrolled from the label roll 200. Accordingly, the distance from the roller 31 on the feed path 30 to the bent portion Pc becomes farther than that of the label roll 200 having the relatively large diameter.

As a result, an angle between the unrolled portion of the label paper P and the tangential direction of the outer circumferential surface 200A of the label roll 200 becomes smaller, and the degree of bending of the bent portion (or reverse-curled portion) becomes weaker.

Also, when the diameter of the label roll 200 is relatively small, the roll diameter in the state of being rolled as the label roll 200 is also relatively small. Therefore, the curl portion (curled inward of the roll) having the smaller diameter is generated. Because of the above matters, when the diameter of the label roll 200 is relatively small, the bent portion is canceled with the curled portion even if the bent portion opposite to the curled portion is generated. Therefore, the shape and position of the bent portion Pc are changed from the state that the diameter of the label roll 200 is relatively large, so the bent portion becomes weaker or smaller.

As a result, even if the bent portion Pc generated when the diameter of the label roll 200 is relatively small is left at the leading end of the next label paper P, it is hardly stuck in the feed path 30.

As described above, the bent portion Pc generated when the diameter of the label roll 200 is relatively small is located at the position far away from the roller 31 on the feed path 30. If the fixed length in the constant length feed control is set based on the position past the bent portion Pc generated when the diameter of the label roll 200 is relatively small, a portion which would not be stuck in the feed path 30 is also cut. As a result, the useless blank portion in the printed paper increases.

Therefore, the useless blank portion in the printed paper can be reduced by setting the fixed length for the constant length feed control in a range where the bent portion Pc passes the cut position when the diameter of the label roll 200 is larger than a predetermined diameter and by setting the fixed length for the constant length feed control in a range where the bent portion Pc does not or may not pass the cut position when the diameter of the label roll 200 is smaller than the predetermined diameter.

In other words, when the diameter of the label roll 200 is at least one of diameters within a range of the diameters that are smaller than the predetermined diameter (particularly when the diameter is much smaller), the constant length in the constant length feed control set in advance when the diameter of the label roll 200 is larger than the predetermined diameter is set to the length such that the cutting operation by the cutter portion 60 is performed at a position that does not pass the bent portion whose position and shape have been changed from those of the bent portion generated when the diameter is relatively large.

In addition, when the diameter of the label roll 200 becomes smaller, the label paper P cannot be unrolled by its own weight and the label roll 200 comes into contact with an inlet portion 32 of the feed path 30. In this case, the label roll 200 is completely constrained and unrolled in the tangential direction. Accordingly, the occurrence of the bent portion is eliminated or almost eliminated, and no matter where the label paper P is cut, the label paper P is not be stuck in the feed path 30 during the next feeding.

Note that the controller 80 may perform the constant length feed control only for the first feed operation after the elapsed time from the last feeding operation exceeds a preset time (e.g., four hours). However, the controller 80 cannot detect the elapsed time from the last feeding operation if the power supply 70 is turned off after the last feeding operation.

In this case, the controller 80 also cannot determine whether the elapsed time from the last feeding operation has exceeded the preset time or not. Accordingly, if the power supply 70 is turned off after the last feeding operation, the controller 80 may perform the constant length feed control for the first feeding operation after the power supply 70 is turned on the same as the case that the elapsed time has exceeded the preset time.

In the case that the elapsed time from the last feeding operation can be continuously detected, for example by using the power of the secondary battery even when the power supply 70 is cut off, the constant length feed control is not always performed for the first feeding operation after the power supply 70 is turned on, but may be performed only when the elapsed time has exceeded the preset time.

Figure 4:
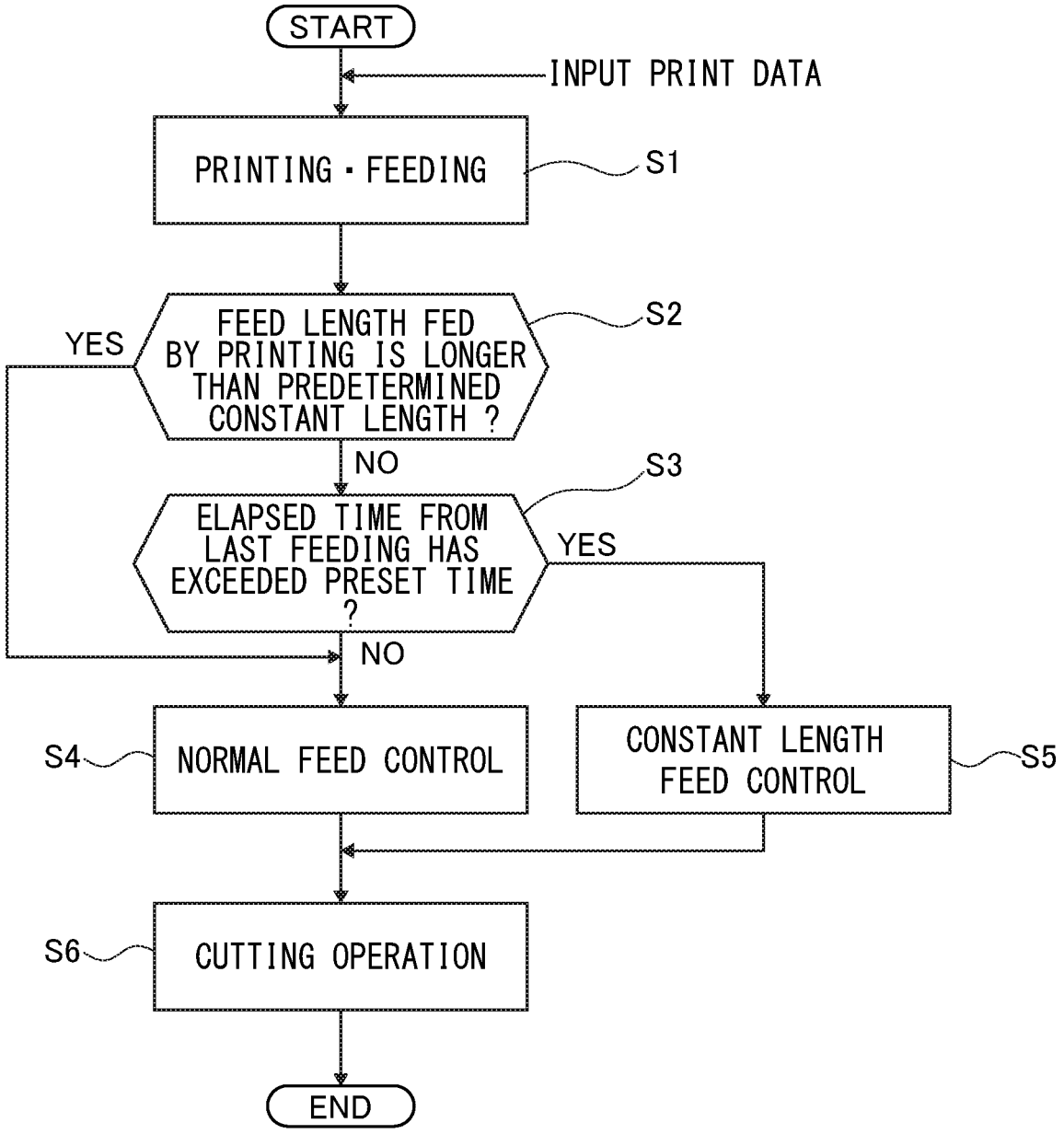
FIG. 4 is a flowchart illustrating a flow of a process for switching between the constant length feed control and the normal feed control by a controller.

FIG. 4 is a flowchart illustrating a flow of a process for switching the normal feed control and the constant length feed control by the controller 80.

With regard to the feed control by the controller 80, the flow of the process for switching the normal feed control and the constant length feed control by the controller 80 will be described with reference to the flowchart shown in FIG. 4 hereinafter.

First, receiving the print data when the power supply 70 is on, the controller 80 controls the thermal head portion 40 and the platen roller 50 to perform printing on the label paper P while feeding the label paper P toward the ejection port 11 in accordance with the input print data (S1 in FIG. 4). Feeding the label paper P toward the ejection port 11 unrolls the label paper P from the label roll 200.

Then, the controller 80 determines whether the feed length fed by the printing is longer than the predetermined fixed constant length or not (S2). This constant length is a predetermined length set in advance such that the bent portion Pc passes the cut position of the cutter portion 60.

In the case that the feed length fed by the printing is longer than the predetermined fixed constant length (YES in S2), the controller 80 controls the operation of the platen roller 50 to feed the label paper P with the normal feed control (S4). Then, the cutter portion 60 cuts the label paper P (S6), and the process is terminated.

In the above case, the bent portion Pc is within the printed range. Accordingly, the bent portion Pc is cut off when the label paper P is cut at the margin right after the printed portion.

Specifically, the paper is cut at a position where the printing process ends or at a position on the rear (upstream) side in the feed direction of the position where the printing process ends when the printed range is positioned forward (downstream) of the bent portion Pc in the feed direction by the printing process.

On the other hand, in the case that the feed length by the printing is shorter than the predetermined fixed constant length (NO in S2), the controller 80 determines whether the elapsed time from the last feeding has exceeded the preset time or not (S3). This is because the bent portion Pc does not exist within the printed range and the bent portion (reverse-curled portion) is not generated unless the bending state continues for the preset time.

In the case that the elapsed time after the last feeding has not exceeded the preset time (NO in S3), the controller 80 controls the operation of the platen roller 50 to feed the label paper P with the normal feed control (S4). Then, the cutter portion 60 cuts the label paper P (S6), and the process is terminated. The bent portion is not generated when the elapsed time has not exceeded the preset time, and accordingly, a portion of the paper fed with the normal feed control is cut.

On the other hand, in the case that the elapsed time after the last feeding has exceeded the preset time (YES in S3), the controller 80 controls the operation of the platen roller 50 to feed the label paper P with the constant length feed control (S5). Then, the cutter portion 60 cuts the label paper P (S6), and the process is terminated.

When the elapsed time has exceeded the preset time, the bent portion has been generated. Accordingly, the platen roller 50 is controlled to feed the label paper P with the constant length feed control (S5), and the portion of the label paper P past the bent portion Pc is cut by the cutter portion 60 (S6). Therefore, it is possible to prevent the bent portion Pc from being left in the leading end of the next label paper P and from being stuck in the feed path 30. Accordingly, the printer 100 of the present embodiment can effectively prevent the paper jam of the paper P caused by the bent portion that may be generated at the portion where the label paper P is unrolled from the linerless label roll when the prolonged standby state persists.

In the above description with reference to the flowchart, it is assumed that the power supply 70 is always on. However, when the power supply 70 has been turned off from the last feeding and accordingly the elapsed time from the last feeding cannot be identified, the controller 80 also determines whether the feeding is the first feeding since the power supply 70 has been turned on in S3 (Step 3) shown in FIG. 4 along with the determination whether the elapsed time from the last feeding has exceeded the preset time or not. Note that the predetermined conditions for the constant length feed control include "the first feeding since the power supply 70 has been turned on".

Then, in the case that the feeding is the first feeding since the power supply 70 has been turned on (YES in S3), the constant length feed control is set (S5). On the other hand, in the case that the feeding is not the first feeding since the power supply 70 has been turned on (NO in S3), the controller 80 determines whether the elapsed time has exceeded the preset time or not. Either the constant length feed control (S5) or the normal feed control (S4) is set in accordance with the determination result.

Other than the automatic feeding operation described above, in a printer that has a function to feed the label paper P while a feed button is manually being pressed, for example, when the elapsed time since the last feeding has exceeded the preset time, the controller 80 may perform the constant length feed control to eject the bent portion Pc from the ejection port 11 regardless of how long the feed button is pressed.

In addition, a feeding amount in the case that the constant length feed control is performed in response to the time when the feed button is being pressed manually may be adjusted by considering the length that has been manually fed. Also, the elapsed time since the last feed may be reset when the feed button is manually pressed.

In the printer 100 according to the present embodiment, the constant length feed control is also performed when the diameter of the label roll 200 is smaller than the predetermined diameter. However, the printer may include a detector for detecting the diameter of the label roll 200, and the normal feed control may be only performed without performing the constant length feed control when the detector detects that the diameter of the label roll 200 becomes smaller than the predetermined diameter.

The printer 100 according to the present embodiment performs the constant length feed control when the last feeding operation for the label paper P has exceeded the preset time or is a first feeding operation after the power has been turned off. However, the printer of the present disclosure is not limited to the above operations. The constant length feed control may be performed when the feeding operation for the label paper P meets a predetermined condition set in advance.

In addition, the printer 100 according to the present embodiment is the thermal transfer printer. The printer of the present disclosure is not limited to the thermal transfer printer but may be an impact dot printer, an ink-jet printer, or the like.

What is claimed is:

1. A printer for printing on a label paper unrolled from a linerless label roll, the printer comprising:

a print head portion that is configured to print on the label paper;

a feeding portion that is configured to feed the label paper;

a cutter portion that is configured to cut the label paper; and a controller that is configured to control operations of the print head portion, the feeding portion, and the cutter portion, wherein the label paper comprises a bent portion generated in a portion right after unrolled from the label roll, the bent portion changing in accordance with a diameter of the label roll, and wherein the controller is configured to control the feeding portion to feed the label paper by a constant length that is set in advance with respect to a predetermined diameter of the label roll so that a cutting operation by the cutter portion is performed at a position past a bent portion that is generated when the diameter of the label roll is larger than the predetermined diameter if a feeding operation for the label paper meets a predetermined condition set in advance.

2. The printer according to claim 1, wherein when the diameter of the label roll is at least one of diameters within a range of the diameters that are smaller than the predetermined diameter, the constant length that is set in advance with respect to the predetermined diameter has a length such that the cutting operation by the cutter portion is performed at a position that does not pass a bent portion that has been changed from the bent portion and is generated when the diameter of the label roll is larger than the predetermined diameter.

3. The printer according to claim 1, wherein the controller is configured to perform a normal feeding operation in which a margin right after a printed portion is fed to a cutting position of the cutter portion without feeding the label paper by the constant length that is set in advance with respect to the predetermined diameter when the diameter of the label roll is smaller than the predetermined diameter.

4. The printer according to claim 1, wherein the controller is configured to control the feeding portion so that the cutting operation by the cutter portion is performed at a position where printing by a printing operation ends or at a position upstream in a feeding direction of the position where the printing ends when an area of the label paper to be printed by the printing operation is fed to an upstream side in the feeding direction from the bent portion by the feeding operation for the label paper along with the printing operation by the print head portion and the feeding portion.

5. The printer according to claim 1, wherein the predetermined condition is a first feeding operation after an elapsed time from a last feeding operation for the label paper has exceeded a preset time or a first feeding operation after a power supply is turned off.

* * * * *